US009068246B2

(12) United States Patent
Bruno et al.

(10) Patent No.: US 9,068,246 B2
(45) Date of Patent: Jun. 30, 2015

(54) DECARBONIZATION PROCESS FOR CARBOTHERMICALLY PRODUCED ALUMINUM

(75) Inventors: Marshall J. Bruno, Greensburg, PA (US); Gerald E. Carkin, Tarentum, PA (US); David H. DeYoung, Export, PA (US); Ronald M. Dunlap, Sr., Brackenridge, PA (US)

(73) Assignee: Alcon Inc., Pittsburgh, PA (US)

( * ) Notice: Subject to any disclaimer, the term of this patent is extended or adjusted under 35 U.S.C. 154(b) by 775 days.

(21) Appl. No.: 12/334,687

(22) Filed: Dec. 15, 2008

(65) Prior Publication Data

US 2010/0147113 A1 Jun. 17, 2010

(51) Int. Cl.

| | |
|---|---|
| ***C21B 11/10*** | (2006.01) |
| ***C21B 13/12*** | (2006.01) |
| ***C21C 5/52*** | (2006.01) |
| ***C21C 5/54*** | (2006.01) |
| ***C22B 4/00*** | (2006.01) |
| ***C22B 21/02*** | (2006.01) |
| ***C22B 5/06*** | (2006.01) |
| ***C22B 21/06*** | (2006.01) |

(52) U.S. Cl.
CPC . *C22B 21/02* (2013.01); *C22B 5/06* (2013.01); *C22B 21/064* (2013.01)

(58) Field of Classification Search
None
See application file for complete search history.

(56) References Cited

U.S. PATENT DOCUMENTS

| | | | | |
|---|---|---|---|---|
| 1,219,797 | A | 3/1917 | Barnett et al. | 423/439 |
| 1,222,593 | A | 4/1917 | Barnett et al. | 423/439 |
| 2,090,451 | A | 8/1937 | Kruh | 75/674 |
| 2,255,549 | A | 9/1941 | Kruh | 75/10.18 |
| 2,755,178 | A | 7/1956 | Rasmussen | 75/10.59 |
| 2,776,884 | A | 1/1957 | Grunert | 75/674 |
| 2,829,961 | A | 4/1958 | Miller et al. | 75/674 |
| 2,974,032 | A | 3/1961 | Grunert et al. | 75/10.27 |
| 3,068,092 | A | 12/1962 | Menegoz | 75/678 |
| 3,169,854 | A | 2/1965 | Rapson | 75/10.28 |

(Continued)

FOREIGN PATENT DOCUMENTS

| | | |
|---|---|---|
| RU | 95122501 | 3/1996 |
| RU | 2007111945 | 3/2006 |

OTHER PUBLICATIONS

Bruno, M.J., *Aluminium Carbothermic Technology*, Retrieved from the Internet: URL:http://www.osti.gov/bridge/purl.cover.jsp;jsessionid=F631E937A8806276EA77088DA10D11COA?purl=/838679-h1h8sh/> [retrieved on Feb. 15, 2010] pp. 31-32, Dec. 31, 2004.

(Continued)

*Primary Examiner* — Yoshitoshi Takeuchi
(74) *Attorney, Agent, or Firm* — Greenberg Traurig, LLP

(57) ABSTRACT

A method of recovering aluminum is provided. An alloy melt having $Al_4C_3$ and aluminum is provided. This mixture is cooled and then a sufficient amount of a finely dispersed gas is added to the alloy melt at a temperature of about 700° C. to about 900° C. The aluminum recovered is a decarbonized carbothermically produced aluminum where the step of adding a sufficient amount of the finely dispersed gas effects separation of the aluminum from the $Al_4C_3$ precipitates by flotation, resulting in two phases with the $Al_4C_3$ precipitates being the upper layer and the decarbonized aluminum being the lower layer. The aluminum is then recovered from the $Al_4C_3$ precipitates through decanting.

12 Claims, 1 Drawing Sheet

(56) References Cited

U.S. PATENT DOCUMENTS

| | | | | | |
|---|---|---|---|---|---|
| 3,198,625 | A | | 8/1965 | Stroup | 75/684 |
| 3,211,547 | A | | 10/1965 | Jarrett et al. | 75/679 |
| 3,230,072 | A | | 1/1966 | Johnson | 75/10.27 |
| 3,607,221 | A | | 9/1971 | Kibby | 75/10.21 |
| 3,715,200 | A | | 2/1973 | Archibald et al. | 75/10.22 |
| 3,721,546 | A | | 3/1973 | Shiba et al. | 75/10.27 |
| 3,767,382 | A | | 10/1973 | Bruno et al. | 75/678 |
| 3,839,019 | A | | 10/1974 | Bruno et al. | 75/681 |
| 3,846,122 | A | | 11/1974 | Valdo | 75/675 |
| 3,849,119 | A | | 11/1974 | Bruno et al. | 75/678 |
| 3,958,979 | A | | 5/1976 | Valdo | 75/685 |
| 3,971,653 | A | | 7/1976 | Cochran | 75/10.27 |
| 3,975,187 | A | * | 8/1976 | Kibby | 75/10.27 |
| 4,177,060 | A | | 12/1979 | Tylko | 75/10.21 |
| 4,216,010 | A | | 8/1980 | Kibby | 75/68 |
| 4,221,590 | A | | 9/1980 | Dawless et al. | 75/10.11 |
| 4,222,830 | A | | 9/1980 | Dawless et al. | 205/832 |
| 4,239,606 | A | | 12/1980 | Dawless et al. | 205/379 |
| 4,246,249 | A | | 1/1981 | Dawless | 423/348 |
| 4,256,717 | A | | 3/1981 | Dawless | 423/348 |
| 4,273,627 | A | | 6/1981 | Dawless et al. | 205/382 |
| 4,294,612 | A | | 10/1981 | Dawless et al. | 75/10.11 |
| 4,299,619 | A | | 11/1981 | Cochran et al. | 75/10.27 |
| 4,312,846 | A | | 1/1982 | Dawless | 423/348 |
| 4,312,847 | A | | 1/1982 | Dawless | 423/348 |
| 4,312,848 | A | | 1/1982 | Dawless | 423/348 |
| 4,312,849 | A | | 1/1982 | Kramer | 423/348 |
| 4,409,021 | A | | 10/1983 | Moore | 75/10.27 |
| 5,342,429 | A | * | 8/1994 | Yu et al. | 75/680 |
| 5,453,110 | A | | 9/1995 | Yu et al. | 75/681 |
| 6,440,193 | B1 | | 8/2002 | Johansen et al. | 75/10.27 |
| 6,475,260 | B2 | | 11/2002 | LaCamera | 75/10.27 |
| 6,530,970 | B2 | | 3/2003 | Lindstad | 75/10.27 |
| 6,805,723 | B2 | | 10/2004 | Aune et al. | 75/10.27 |
| 6,849,101 | B1 | | 2/2005 | Fruehan et al. | 75/10.27 |
| 6,980,580 | B2 | | 12/2005 | Aune et al. | 373/61 |
| 7,169,207 | B2 | | 1/2007 | Vegge et al. | 75/10.27 |
| 2006/0042413 | A1 | | 3/2006 | Fruehan | 75/10.27 |
| 2008/0016984 | A1 | | 1/2008 | Christini | 75/10.27 |
| 2008/0196545 | A1 | | 8/2008 | Fruehan | 75/243 |
| 2009/0013823 | A1 | | 1/2009 | Fruehan et al. | 75/10.27 |
| 2010/0107815 | A1 | | 5/2010 | Fruehan et al. | 75/330 |

OTHER PUBLICATIONS

Johansen Kai, et al, *Aluminum carbothermic technology alcoa-elkem advanced reactor process*, TMS Light Metals: Light Metals, Proceedings of the Technical Sessions, Technical TMS Annual Meeting, No. 132, p. 404, Mar. 2, 2003.

International Search Report and Written Opinion, dated Feb. 25, 2010, from related International Application No. PCT/US2009/064897.

Johansen et al., *Carbothermic Aluminum*, Proceedings 6$^{th}$ Conference on Molten Slags, Fluxes and Salts, Stockholm, Sweden-Helsinki, Finland (Jun. 12-17, 2002).

Morel et al., *Alternative Process for Aluminum Production*, pp. 1-44, (2007).

Saavedra et al., *Investigating the Viability of Carbothermic Alumina Reduction*, Journal of Metals, pp. 32-36 (Nov. 1988).

* cited by examiner

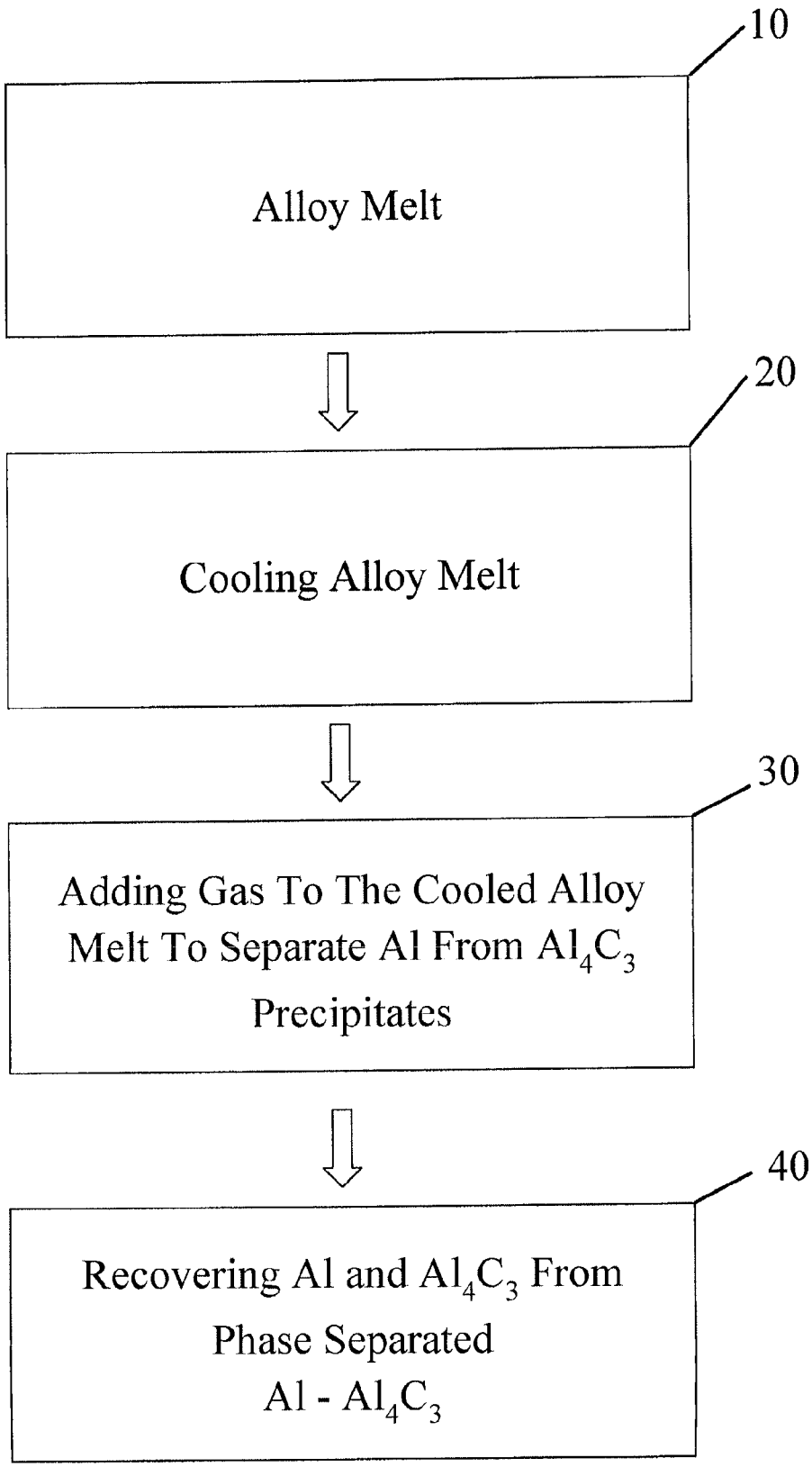
10
Alloy Melt
20
Cooling Alloy Melt
30
Adding Gas To The Cooled Alloy Melt To Separate Al From $Al_4C_3$ Precipitates
40
Recovering Al and $Al_4C_3$ From Phase Separated Al - $Al_4C_3$

DECARBONIZATION PROCESS FOR CARBOTHERMICALLY PRODUCED ALUMINUM

GOVERNMENT FUNDING STATEMENT

This invention was made with government support under Contract No. DE-FC36-001D13900, awarded by the U.S. Department of Energy. The government has certain rights in the invention.

BACKGROUND OF THE INVENTION

The present invention relates to a method of recovering commercial grade aluminum from carbothermically produced Al—C alloy. More particularly, the invention relates to a method for separating and recovering the aluminum from the alloy that contains aluminum and aluminum carbide ($A4C_3$) particles, that is, decarbonizing the aluminum.

Generally, the overall reaction of direct carbothermic reduction of alumina to produce aluminum is $Al_2O_3+3C=2Al+3CO$. The carbothermic reduction of alumina may take place in several steps: (1) $2Al_2O_3+9C=Al_4C_3+6CO$ and (2) $Al_4C_3+Al_2O_3=6Al+3CO$.

The present invention relates to the decarbonization process after the carbothermic reduction of alumina to produce aluminum.

SUMMARY OF THE INVENTION

In one embodiment, the present invention provides a method of recovering commercial grade aluminum. In another embodiment, a method of recovering aluminum from an alloy melt that comprises $Al_4C_3$ precipitates and aluminum, by cooling the alloy melt; then adding a sufficient amount of a finely dispersed gas to the alloy melt at a temperature of about 700° C. to about 900° C. to separate the aluminum from the $Al_4C_3$ precipitates. The aluminum recovered is a decarbonized carbothermically produced aluminum where the step of adding a sufficient amount of the finely dispersed gas effects flotation of the $Al_4C_3$ precipitates.

In one embodiment, the final step of separating the aluminum from the $Al_4C_3$ precipitates is by decanting, sub-surface or vacuum tapping the decarbonized aluminum to a receiver.

In a further embodiment, the finely dispersed gas used is an inert gas. In another embodiment, the inert gas used is either argon or carbon dioxide.

In yet another embodiment, the finely dispersed gas used is a mixed gas. In another embodiment, the mixed gas is a mixture of inert gas with a reactive gas. In a further embodiment, the inert gas used is argon and the reactive gas is chlorine.

In a further embodiment, the gas is introduced to the alloy melt by a rotating disperser, a bubbler tube, or a porous diffuser.

In yet another embodiment, the gas is introduced to the alloy melt when the alloy melt is at a temperature of about 700° C. to about 900° C.

Accordingly, it is one embodiment of the invention to provide a method of producing aluminum with a very low carbon content.

It is another embodiment of the invention to provide a method of recovering decarbonized carbothermically produced aluminum as claimed herein.

These and other further embodiments of the invention will become more apparent through the following description and drawing.

BRIEF DESCRIPTION OF THE DRAWINGS

For a fuller understanding of the invention, reference is made to the following description taken in connection with the accompanying drawing(s), in which:

FIG. 1 is a flow chart showing one embodiment of the method of producing aluminum in accordance with the present invention.

DETAILED DESCRIPTION OF THE PREFERRED EMBODIMENTS

The followings are the definitions of the terms used in this application. As used herein, the term "alloy melt" means a melt of at least an aluminum alloy and $Al_4C_3$ particles. Note that the alloy melt may include or contain other materials such as $Al_2O_3$, C, oxycarbides, etc.

As used herein, the term "sufficient amount" means an amount that facilitates the separation of aluminum and aluminum carbide in order to recover greater than 90 weight % of the available aluminum.

The present invention provides a method of decarbonizing aluminum.

In one embodiment, the present invention discloses a method of recovering aluminum from a carbothermically produced alloy melt that comprises aluminum carbide, such as $Al_4C_3$ and aluminum. The alloy melt is cooled and a sufficient amount of a finely dispersed gas is added to the alloy melt at a temperature of about 700° C. to about 900° C., separating the aluminum from the $Al_4C_3$ precipitates.

In one embodiment, FIG. 1 shows a flow chart outlining the principal steps of the present invention. Here, an alloy melt is provided in the first step 10. In the second step 20, the alloy melt is cooled. In the third step 30, a finely dispersed gas is added to the alloy melt to assist in transporting the solid precipitates away from the aluminum, forming two phases with the solids being the upper layer. The aluminum is then removed and recovered in the fourth step 40 by means of decanting or tapping.

In the initial step, an alloy melt is provided. In one embodiment, the alloy melt is tapped into a crucible or ladle at very high temperature with the carbon in solution in the form of $Al_4C_3$. In one embodiment, the temperature of the alloy melt is at least about 2,000° C.

In the second step, alloy melt is cooled. As the alloy melt cools, the $Al_4C_3$ solidifies and precipitates. In one embodiment, the alloy melt is cooled to a temperature of about 700° C. to about 900° C. In one embodiment, the alloy mixture is cooled by the addition of solid and/or liquid aluminum. In one embodiment, the cooling aluminum is solid and/or liquid scrap of acceptable composition.

In the third step, a finely dispersed gas is added to the alloy melt. In one embodiment, the gas is distributed through the alloy melt by a bubbler tube or a rotating disperser or a porous diffuser at a temperature of about 700° C. to about 900° C. In another embodiment, the action of the gas provides a flotation effect in transporting the solid particles away from the aluminum, with the solid particles rising to the surface. In one embodiment, the rotating disperser is a straight bladed turbine with multiple blades and with an overall diameter of 40 to 60% of the treatment crucible or ladle. In another embodiment, the disperser is rotated at 100 to 250 revolutions per minute. In another embodiment, the flotation gas is injected through a rotary seal down the hollow shaft of the disperser, exiting underneath the bottom surface of the turbine.

Suitable types of gases that may be used in the present invention include, but are not limited to, inert gases, such as argon, carbon dioxide or nitrogen or a mixture of inert gases with a reactive gas, such as $Cl_2$. In one embodiment, argon is mixed with about 2 to about 10 volume % of $Cl_2$. In one embodiment, argon is mixed with 5 volume % of $Cl_2$ gas. In one embodiment of the invention, an effective flow rate of gas needed to separate aluminum from the $Al_4C_3$ precipitates is about 5 $cm^3$/min per $cm^2$ of crucible cross sectional area. In one embodiment, the gas dispersion time is about 20 to 30 minutes. In another embodiment, the amount of gas changes depending on the amount of alloy melt quantity.

In the fourth step, decarbonized aluminum is then recovered from the treatment crucible or ladle. In one embodiment, the aluminum is decanted to a receiver, such as a mold.

Optionally, the solids that remain in the treatment vessel are then removed and stored for future recycle to the carbothermic furnace.

Table 1 below shows the amount of aluminum recovery for five examples in which the aluminum recoveries range from 62% to 96%. The aluminum product contained less that 600 ppm of carbon. The gas composition used in Table 1 is 95% argon and 5% $Cl_2$ by volume.

TABLE 1

| | Example 1 | Example 2 | Example 3 | Example 4 | Example 5 |
|---|---|---|---|---|---|
| Initial charge, kgs. | 1.0-1.5 | 10-16 | 50.9 | 50.9 | 50.9 |
| Initial carbon, weight % | 1.3-3.2 | 1.1-4.2 | | | |
| Melt temperature, ° C. | 750 | 750-800 | 774 | 774 | 774 |
| Aluminum product recovered, weight % | 96 by rotor | 95 by rotor | 92.6 by rotor | 90.6 by rotor | 62.0 by rotor |
| Carbon content in the aluminum product recovered, ppm | less than 100 | less than 600 | 11.6 | 26.3 | 22.0 |

EXAMPLE 1

In Example 1, the melts were approximately 1 kg in weight. The aluminum carbon alloy compositions contained about 1.3 to about 3.2% of carbon. The compositions were cooled and then gas mixtures of 95% argon and 5% $Cl_2$ were fmely dispersed into the alloy compositions by a rotor at a temperature of 750° C. Here, the aluminum recovery was 96% or higher and the aluminum product contained less than 100 ppm of carbon and less than 100 ppm of chlorides.

EXAMPLE 2

In Example 2, the melts were approximately 10-16 kg in weight. The aluminum carbon alloy compositions contained about 1.1 to about 4.2% of carbon. The compositions were cooled and then gas mixtures of 95% argon and 5% $Cl_2$ were finely dispersed into the alloy compositions by a rotor at temperatures of 750-800° C. Here, the aluminum recoveries were 95% or higher and the aluminum product contained less than 600 ppm of carbon.

It should be noted that the aluminum recovery is a function of the initial carbon content of the alloy melt. Recovery decreases as carbon content increases. Based on experimental results, recovery decreases by about 4 to 5% for every one % carbon content increase.

EXAMPLE 3

In Example 3, 50.9 kg of impure carbothermic alloy was added to 50.9 kg of molten aluminum contained in a 15.5 inch dia.×23.25 inch deep clay-graphite crucible at 774° C. The carbothermic alloy was mechanically submerged using steel tools. A graphite rotor having a 6" diameter rotor with 9 teeth evenly spread around the circumference was immersed into the molten mixture. This rotor was attached to a 3 inch diameter graphite tube. A gas mixture of Ar-5% $Cl_2$ was supplied through the shaft and dispersed into the molten mixture by rotating the shaft/rotor assembly at 350 rpm. During a 30 minute treatment time with this gas mixture, solid materials on the surface of the molten alloy mixture were continually pushed below the surface by mechanical tamping. After the treatment was completed, the rotor was removed from the metal and the thick dross layer that collected on the surface was removed. It should be noted that this dross contained $Al_4C_3$ particles, aluminum oxide, aluminum oxycarbides and some entrained aluminum metal. The resulting product metal was then manually removed from the crucible with a steel ladle. A total of 77.3 kg of metal was removed from this operation. The dross that was removed was subsequently processed in a separate step by immersing it into a molten salt bath (50% NaCl-50% KCl) to recover the residual metal in the dross. A total of 2.1 kg of metal was removed from the dross during this step. The overall metal recovery for the fluxing operation was calculated to be [(77.3−50.9)/(77.3−50.9+2.1)]*100=92.6%. The carbon content of the aluminum removed from the process was analyzed to be 11.6 ppm.

EXAMPLE 4

In Example 4, 50.9 kg of impure carbothermic alloy was added to 50.9 kg of molten aluminum at 774° C. The molten mixture was treated using the same method as Example 3, except the treatment gas was pure argon. No chlorine was used in this example. A total of 74.0 kg of aluminum was removed from the process. An additional 2.4 kg of aluminum was recovered from the dross, giving an overall metal recovery of 90.6%. The carbon content of the aluminum recovered from the process was 26.3 ppm.

EXAMPLE 5

In Example 5, 50.9 kg of impure carbothermic alloy was added to 50.9 kg of molten aluminum at 774° C. The molten mixture was treated using the same method as Example 4, except the materials floating on the surface were not mechanically submerged by tamping throughout the process. There was no tamping conducted during this example. A total of 64.0 kg of aluminum was removed from this process. An additional 8.0 kg of aluminum was removed from the dross, giving an overall metal recovery of 62.0%. The carbon content of the aluminum removed from this process was 22.0 ppm.

Examples 3, 4 and 5 show that the impure carbothermic alloy containing approximately 3.5% carbon can be purified using the fluxing method to produce a commercially acceptable alloy with a carbon content of less than 30 ppm. A comparison of Examples 3 and 4 shows that the fluxing process can be used either with or without chlorine in the fluxing gas. A comparison of Example 5 to Examples 3 and 4 show that tamping during the fluxing process considerably improves the recovery. Without tamping the recovery was 62%; when tamping was used the recovery was greater than 90%.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A method comprising:

(a) carbothermically preparing an aluminum alloy melt comprising $Al_4C_3$ precipitates and aluminum metal;

(b) separating the aluminum metal from the $Al_4C_3$ precipitates, wherein the separating step comprises:

introducing a gas into the aluminum alloy melt with a rotating disperser while the aluminum alloy melt is at a temperature of 700° C. to 900° C.;

tamping the $Al_4C_3$ precipitates on the surface of the aluminum alloy melt to push the $Al_4Cl_3$ precipitates below the surface, into the aluminum alloy melt; and (c) recovering the aluminum metal from the melt.

2. The method of claim 1, wherein recovering step (c) comprises:

decanting, sub-surface or vacuum tapping the aluminum to a receiver.

3. The method of claim 1, wherein the gas is an inert gas.

4. The method of claim 3, wherein the inert gas used is either argon or carbon dioxide.

5. The method of claim 3, wherein the inert gas used is nitrogen.

6. The method of claim 1, wherein the carbothermically preparing step (a) comprises:

cooling the aluminum alloy melt.

7. The method of claim 6, wherein the cooling step comprises:

cooling the aluminum alloy melt to a temperature of 700° C. to 900° C.

8. The method of claim 6, wherein the cooling step comprises:

adding solid or liquid aluminum to the aluminum alloy melt.

9. The method of claim 1, wherein the introducing step comprises:

transporting the $Al_4C_3$ precipitates towards a surface of the aluminum alloy melt.

10. The method of claim 1, wherein, concomitant to the carbothermically preparing step (a), the temperature of the alloy melt is at least 2000° C.

11. The method of claim 1, wherein the introducing step comprises:

flowing the gas at a rate of 5 $cm^3$ per min per $cm^2$ of crucible cross-sectional area.

12. The method of claim 1, wherein the introducing step comprises:

rotating the rotating dispenser at 100 to 250 revolutions per minute.

* * * * *

UNITED STATES PATENT AND TRADEMARK OFFICE

CERTIFICATE OF CORRECTION

PATENT NO. : 9,068,246 B2
APPLICATION NO. : 12/334687
DATED : June 30, 2015
INVENTOR(S) : Marshall J. Bruno et al.

It is certified that error appears in the above-identified patent and that said Letters Patent is hereby corrected as shown below:

Title page

Item (73) Assignee: Delete "Alcon Inc." and insert -- Alcoa Inc. --

Signed and Sealed this
Ninth Day of August, 2016

Michelle K. Lee

Michelle K. Lee
*Director of the United States Patent and Trademark Office*